US006521044B1

(12) United States Patent
Obermark

(10) Patent No.: US 6,521,044 B1
(45) Date of Patent: Feb. 18, 2003

(54) ROLLER APPARATUS FOR APPLYING LUBRICANT TO SHEET METAL STOCK

(75) Inventor: John A. Obermark, Beloit, WI (US)

(73) Assignee: LSP Industries, Inc., Rockford, IL (US)

( * ) Notice: Subject to any disclaimer, the term of this patent is extended or adjusted under 35 U.S.C. 154(b) by 0 days.

(21) Appl. No.: 09/439,869

(22) Filed: Nov. 12, 1999

(51) Int. Cl.[7] ..... B05C 1/00
(52) U.S. Cl. ..... 118/227; 118/684
(58) Field of Search ..... 184/17; 118/22, 118/684, 244, 258, 227, 249, 262

(56) References Cited

U.S. PATENT DOCUMENTS

| | | | | |
|---|---|---|---|---|
| 3,582,428 | A | * | 6/1971 | Steinberg |
| 3,800,742 | A | * | 4/1974 | Hunter |
| 4,485,132 | A | | 11/1984 | Furuzono et al. ..... 427/428 |
| 5,221,350 | A | * | 6/1993 | Tallier et al. |
| 5,476,546 | A | * | 12/1995 | Zibulla |
| 5,679,162 | A | * | 10/1997 | Caffrey et al. |
| 5,743,964 | A | | 4/1998 | Pankake ..... 118/712 |
| 5,755,883 | A | | 5/1998 | Kinose et al. ..... 118/110 |
| 6,152,068 | A | * | 11/2000 | Colson et al. |

* cited by examiner

*Primary Examiner*—Brenda A. Lamb
(74) *Attorney, Agent, or Firm*—Leydig, Voit & Mayer, Ltd.

(57) ABSTRACT

An apparatus for coating sheet metal strip substrate with lubricant type laminate includes top and bottom roller coaters for pinching the metal therebetween. Each roller coater includes an applicator roll supported between three contact points provided by two support rolls and the sheet metal surface itself. As such the applicator roll can be without and axle and freely removable. The applicator roll is driven by the movement of the metal strip. The roller coaters are movable between engaged and disengaged positions. When in the disengaged position, support brackets on the top roller coater prevent the applicator roll from dropping and replace the bottom support of the sheet metal. Pneumatic cylinders for actuating the top and bottom roller coaters are operatively connected such that the top and bottom roller coaters can "float" or move vertically while at the same time pinching the metal strip therebetween. One of the support rolls also acts as a lubricant transfer roll to transfer lubricant from a plurality of dispensing heads to the applicator roll. The dispensing heads include a cylindrically shaped recess surface receiving the transfer roll and a longitudinal outlet slot thereon for supplying lubricant to the transfer roll. The cylindrically shaped recess surface is spring loaded against the transfer roll. A manifold connects the dispensing heads to a electrically actuated solenoid valve. An electronic controller selectively modulates the solenoid valve to set an application rate for lubricant.

26 Claims, 10 Drawing Sheets

ROLLER APPARATUS FOR APPLYING LUBRICANT TO SHEET METAL STOCK

FIELD OF THE INVENTION

The present invention generally relates to roller coater type apparatus which are used to apply laminate to a substrate, and more particularly to a roller coater for coating one or both sides of a sheet metal strip fed along a predetermined path, such as for example into a press.

BACKGROUND OF THE INVENTION

In the metal forming industry, apparatus commonly known as roller coaters are used to apply a lubricant type laminate to sheet metal strip substrate. The lubricant laminated sheet metal is then typically fed into a press which punches and forms the sheet metal into patterns as desired. The lubricant performs the desirable function of lubricating the tooling of the press when it is working the metal. Sometimes it is desirable to switch the type of lubricant depending upon the particular types of operations being performed to the metal. It is usually desirable to coat both sides of the sheet metal strip with lubricant although it is occasionally desirable to coat only one side of sheet. It may also be desirable to change the width of the laminate application depending upon the width of the metal strip or the operations of the downstream press.

In the sheet metal lubrication industry, the typical roller coater apparatus includes upper and lower roller coater assemblies for application of lubricant to both sides of the sheet metal substrate. The upper and lower roller coaters include respective applicator rolls which pinch the sheet metal strip therebetween to apply lubrication to the top and bottom sides of the sheet metal strip. The applicator rolls are journalled in bearings at their ends for rotation about parallel rotational axes.

Heretofore, prior roller coater apparatus have had several drawbacks. One drawback is that there is typically a substantial amount of downtime and labor required when changing applicator rolls to apply different types of laminate. Another drawback is that roller coaters have less than desirable lubricant application that is either non-uniform or uneven, particularly where a small application rate is desired. This often results in wasted lubricant or alternatively a poorly lubricated press. Yet another drawback is that roller coater apparatus have not been able to adapt to changes in feed of the sheet metal strip.

SUMMARY OF THE INVENTION

It is therefore the general objective of the present invention to provide a more practical and reliable roller coater apparatus that is well suited to apply lubricant to sheet metal strip.

According to certain aspects of the present invention, it is an object to provide a roller coater apparatus that applies a more controlled amount of lubricant on sheet metal strip.

According to another aspect of the present invention, it is an object of the present invention to provide a roller coater apparatus that allows operators to easily change an applicator roll with a replacement roll or a different type of roll.

According to yet another aspect of the present invention, it is an object of the present invention to provide a roller coater apparatus that better accommodates vertical height fluctuations in the sheet metal strip during operation.

Accordingly, the present invention is directed in part towards a novel support arrangement for the applicator roll of a roller coater apparatus which is used to apply lubricant or other laminate to metal strip. The apparatus generally includes top and bottom roller coaters which are adapted to pinch metal strip there between in an engaged position. The support of the applicator roll is accomplished by three contact points arranged in a triangular configuration such that the applicator roll may be carried without the need for a physical connection between the applicator roll and the roller coater apparatus. The first contact point is provided by the metal strip itself A pair of supports such as support rolls or bearing rollers provide the second and third contact points and allow the applicator roll to rotate between the three contact points to apply lubricant to the metal strip.

The present invention is also directed towards the provision of a novel lubricant applicator assembly which generally comprises a transfer roll and a dispensing head. The transfer roll contacts the applicator roll along a laminate transfer line generally parallel with the rotational axis of the applicator roll. The dispensing head has a recessed surface which closely receives the outer cylindrical surface of the transfer roll. The dispensing head includes a longitudinal outlet in the recessed surface which receives laminate and applies laminate to the transfer roll, which in turn applies laminate to the applicator roll.

The present invention is also directed in part towards the provision of pneumatic vertical floatation of the top and bottom roller coater assemblies of a roller coater apparatus. According to this aspect, the roller coater apparatus includes top and bottom roller coater assemblies which are adapted to pinch metal strip there between to selectively coat one or both sides of the metal strip with lubricant. A pneumatic cylinder assembly is provided that is capable of moving upward and downward along with variations with the vertical type of the flow of the metal strip. To accomplish this, at least one pneumatic cylinder assembly is provided that includes a top and a bottom pneumatic cylinder. The top pneumatic cylinder operates the upper roller coater assembly while the bottom pneumatic cylinder operates the lower roller coater assembly. The compartments of the top and bottom cylinders are operatively connected in order to allow the cylinders to move upward and downward in unison without changing the pinching force applied to the sheet metal strip there between.

The present invention is also directed towards an improved control system for controlling the rate at which lubricant is applied to sheet metal strip. According to this aspect, a lubricant supply assembly generally includes a control valve, a manifold connecting the output flow of the control valve to at least one head in the roller coater, and means for modulating the valve between at least two different flow regulating positions to set an application rate of the laminate or lubricant. The modulating means may take the form of an electronic controller that is controllable to change the application rate if so desired.

Other object and advantages of the invention will become more apparent from the following detailed description when taken in conjunction with the accompanying drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE PREFERRED EMBODIMENT

Figure 1:
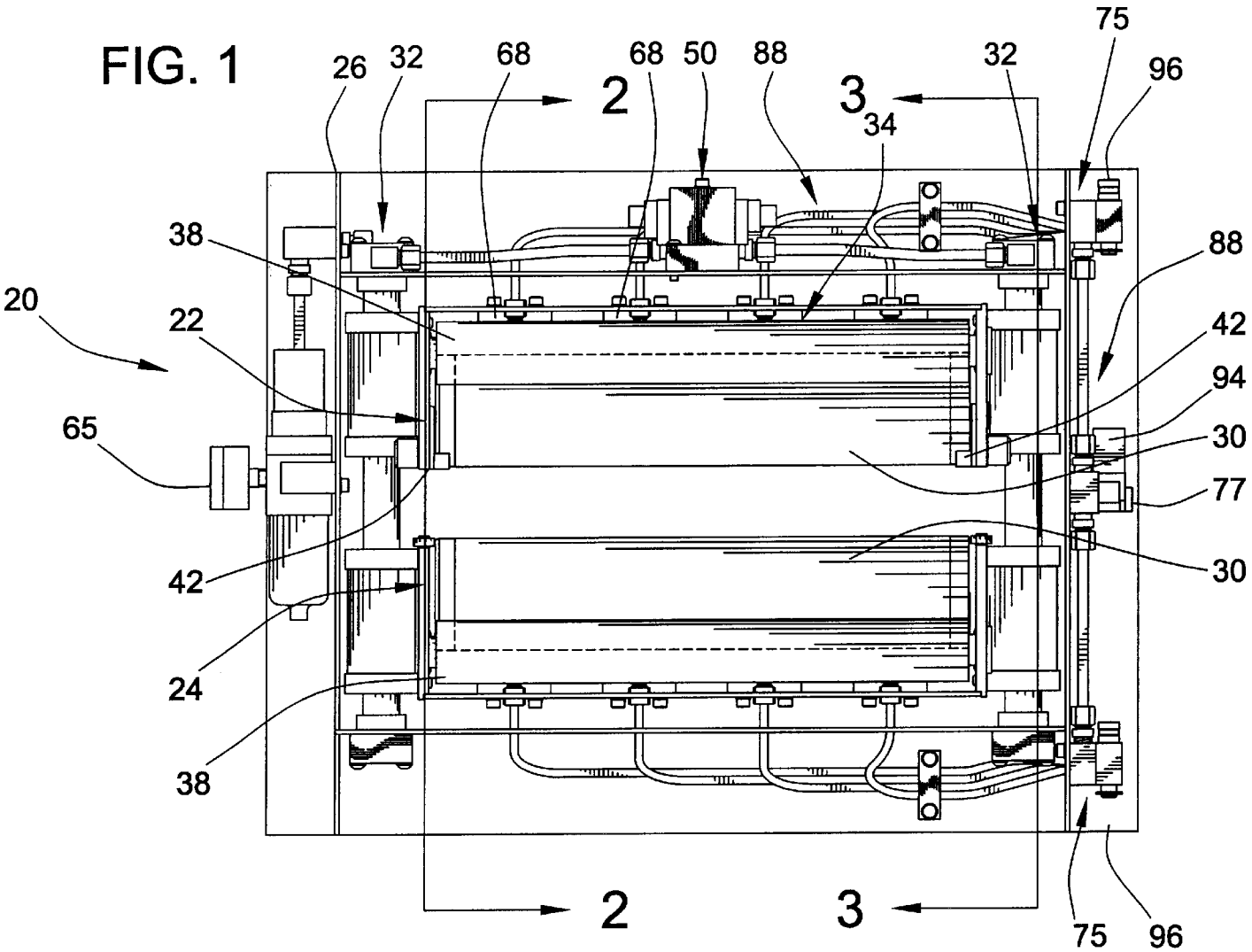
FIG. 1 is a front elevation view of a roller coater apparatus for applying laminate to sheet metal strip, illustrated in a disengaged position.
Figure 2:
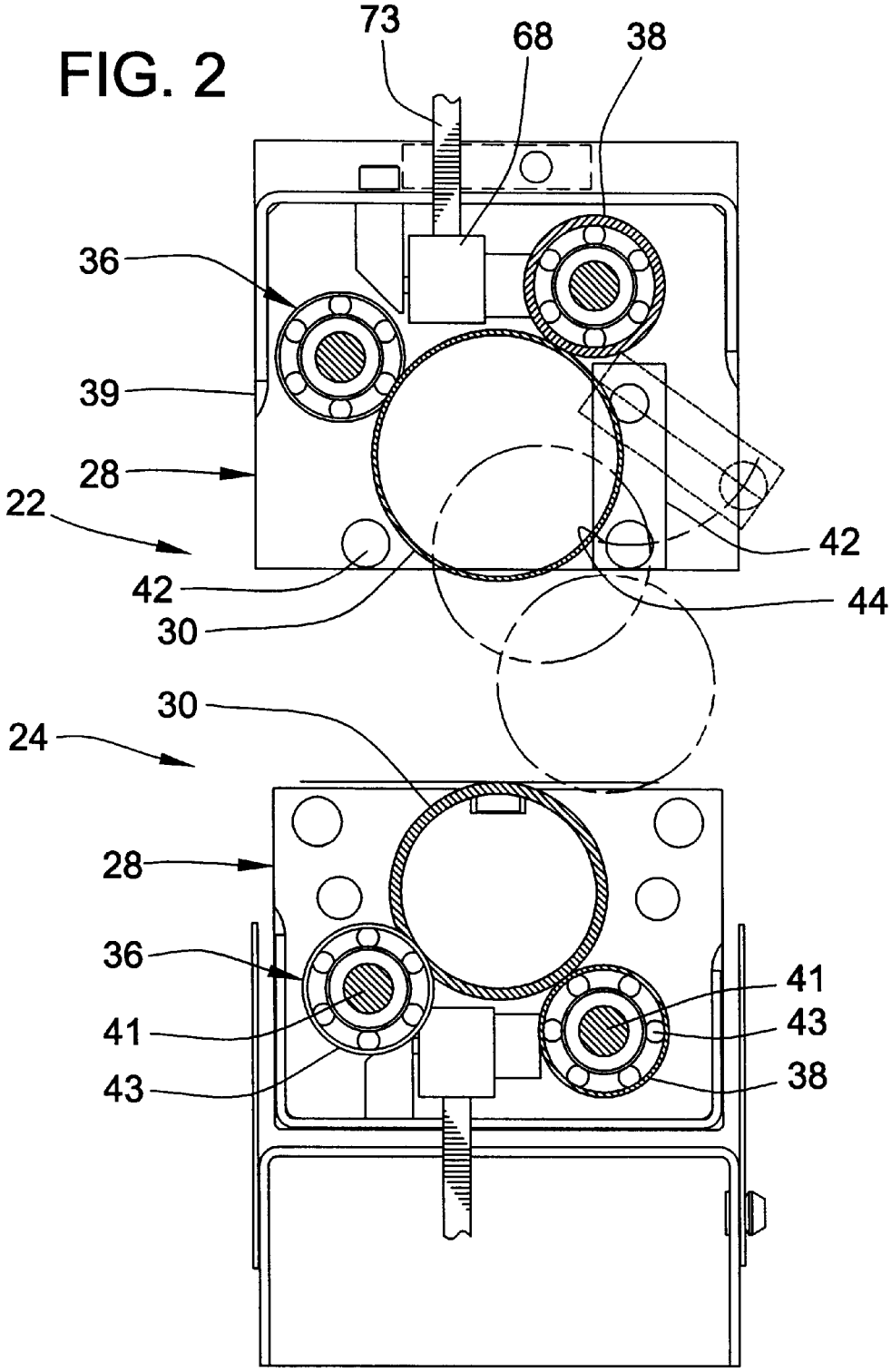
FIG. 2 is a cross-section of the roller coater apparatus of FIG. 1 taken about line 2—2, with hidden lines indicating how the applicator roll is removed.
Figure 9:
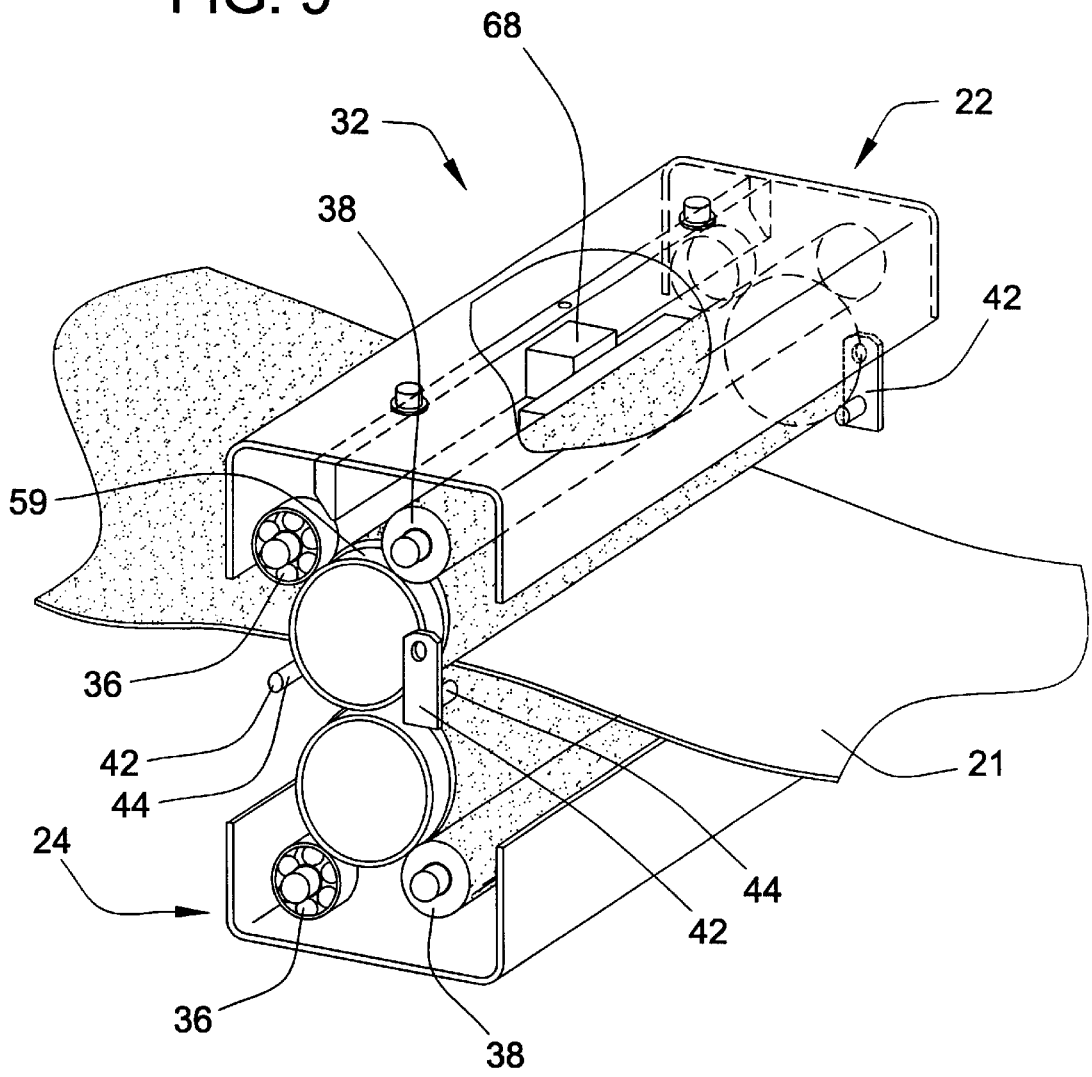
FIG. 9 is a perspective view of certain working parts of the roller coater apparatus shown in FIG. 1, illustrated in an engaged position.

Referring to FIGS. 1, 2 and 9, a roller coater apparatus 20 for applying laminate to sheet metal is illustrated in accordance with a preferred embodiment of the present invention. The roller coater apparatus 20 is adapted to coat one or both sides of sheet metal strip material 21 with a liquid laminate, such as lubricant. The apparatus 20 is preferably positioned upstream of a press (not shown) that forms metal into desired shapes in mass production operations. With this arrangement, the lubricant on the sheet metal strip material 21 lubricates the movable tools (not shown) of the press to ensure sharper cutting tools and a longer lifespan for the tools.

To facilitate coating of both sides of the metal strip material 21, the apparatus 20 preferably includes top and bottom roller coater assemblies 22, 24 (designated as such for ease of understanding because the top roller coater assembly 22 is typically vertically above the bottom roller coater assembly 24). The roller coater assemblies 22, 24 are carried on a stationary support frame 26 and have generally cylindrical applicator rolls 30 that are adapted to pinch the metal strip material therebetween for application of lubricant to top and bottom sides of the metal strip material 21. During operation, the metal strip material 21 is advanced through the roller coater apparatus 20 towards the press by a feed apparatus that is typically separate from the coater apparatus 20. The advancing movement of the metal strip material 21 drives each of the applicator rolls 30 about an axis of rotation. The rotation of the applicator rolls 30 causes them to receive a controlled amount of lubricant across their surface from a lubricant applicator assembly 34. After receiving the controlled amount of lubricant, the applicator rolls 30 subsequently coat the lubricant across the entire or selected surface areas of the metal strip material 21.

Each roller coater assembly 22, 24 also includes a support carriage 28 carried by the frame 26 for linear movement relative thereto. The carriages 28 are mounted between a pair of pneumatic cylinder assemblies 32 which position the carriages 28 relative to each other. In particular, the pneumatic cylinder assemblies 32 are operable to move the roller coater assemblies 22, 24 closely together or far apart between engaged and disengaged positions, as illustrated with a comparison of FIGS. 1 and 9. In the engaged position, the applicator rolls 28 pinch the metal strip material 21 therebetween for application of lubricant. In the disengaged position, the applicator rolls 28 are spaced vertically apart from each other to facilitate service maintenance and/or loading of new stock material to the roller coater.

Figure 11:
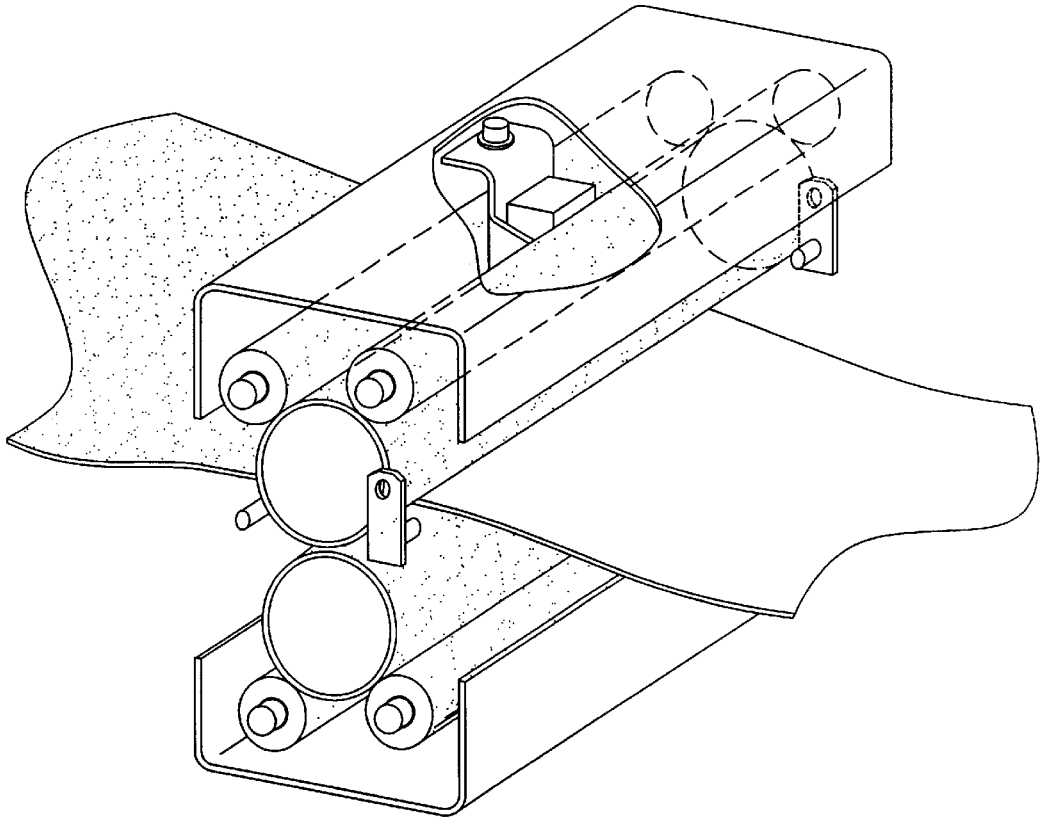
FIG. 11 is a perspective view of certain working parts of a roller coater apparatus according to an alternative embodiment of the present invention.

It is an aspect of the present invention that the applicator rolls are carried between three contact points while in the engaged position, such that a mechanical connection between the applicator roll 30 and the support carriage 28 is not necessary. To provide two of the contact points, a pair of supports which take the form of a bearing roller 36 and a transfer roll 38 are provided for each of the respective top and bottom roller coater assemblies 22, 24. However, other supports and support combinations may also be used such as two support rolls as shown in alternative embodiment of FIG. 11, and/or other similar such support means as a low friction skid support surface. It should be noted that supports which rotate with the applicator rolls are preferred for durability and reliability reasons. In either event, the preferred embodiment of each support includes a stationary support shaft 41 mounted to the support structure 39 of the carriage 28 and ball or roller bearings 43 for facilitating rotation of the roll followers. The rotational axes of the bearing roller 36 and transfer roll 38 are generally parallel with the rotational axis of the applicator roll 30. In the top roller coater assembly 22 the support rolls bearing roller 36 and transfer roll 38 provide support to the top side of the applicator roll 30. In the bottom roller coater assembly 24, the reverse is true, namely, the bearing roller 36 and transfer roll 38 provide support to the bottom side of the applicator roll 30. The bearing roller 36 and transfer roll 38 are preferably made of rigid material such as steel to facilitate proper alignment of the respective applicator rolls 30 of the top and bottom roller coater assemblies 22, 24.

The bearing roller 36 and transfer roll 38 provide two contact points for support of the applicator roll 30. When the roller coater assemblies 22, 24 are in the engaged position, the sheet metal strip material 21 provides the third contact point, and the pinching force between the top and bottom roller coater assemblies 22, 24 maintains the applicator rolls 30 against the bearing roller 36 and transfer roll 38. When the roller coater assemblies 22, 24 are moved apart from each other to the disengaged position, the support provided by the sheet metal strip material 21 ceases to exist. In the bottom roller coater assembly 24, this is of little significance as gravity maintains the applicator roll 30 against the bearing roller 36 and transfer roll 38 for support. However, in the top roller coater assembly 22, gravity causes the applicator roll 30 drop downward away from the bearing roller 36 and transfer roll 38. As such, the preferred embodiment includes means for supporting the upper applicator roll 30 in the disengaged position, which takes the form of two support arms 42 on the top roller coater assembly 22. The support arms 42 include beveled or cylindrical contact surfaces 44 that provide two contact points to support the bottom side of the applicator roll. The contact surfaces 44 are located in close proximity to the outer peripheral surface of the applicator roll 30 while in the engaged position such that the applicator roll moves downward only slightly when the top roller coater assembly moves into the disengaged position. Alternatively, the arms 42 could carry small rolls or rollers if desired to provide the contact points which could also continuously contact the applicator rolls. In the preferred embodiment, the support arms 42 are connected to the support structure 39 of the upper carriage 28, and selectively held in position by a pair of manually operable spring loaded locking mechanisms 47 mounted to the support structure at opposing ends of the roller coater 22.

At least one of the arms 42 is movable between supporting and nonsupporting positions to facilitate removal of the applicator roll 30 if desired. As shown in FIG. 2, one of the arms 42 is pivotably connected to the carriage 28 and is capable of being locked in a conventional manner in the supporting position for support of the applicator roll 30. It is an advantage that facilitates easy changing of applicator rolls 30. Applicator rolls may be changed when worn or damaged or alternatively when switching between two different types of lubricant, or other maintenance reason. Little labor and effort is necessary to change the applicator roll as the applicator roll 30 drops down once the support arm 42 is moved to the non-supporting position. It should be noted that the applicator roll 30 of the bottom roller coater assembly 30 may be easily lifted off the bearing roller 36 and transfer roll 38 to facilitate changing of the applicator roll 30. It is an advantage that the applicator rolls 30 do not need an axle journalled in bearings for support or location.

Figure 10:
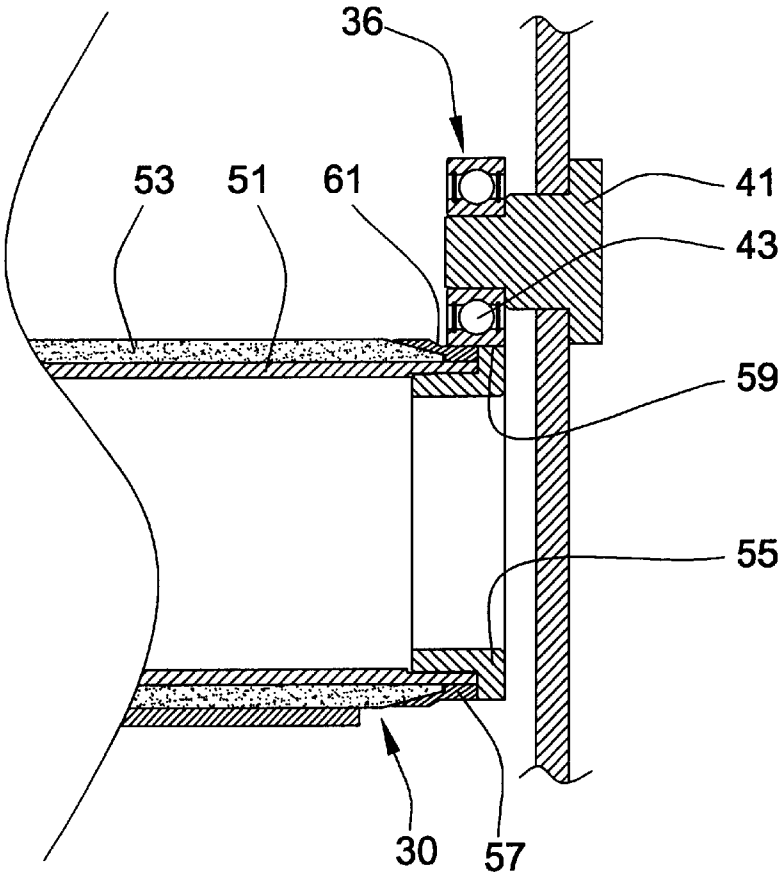
FIG. 10 is a cross section of certain parts of a roller coater of the roller coater apparatus illustrated in FIG. 1.
Figure 10:
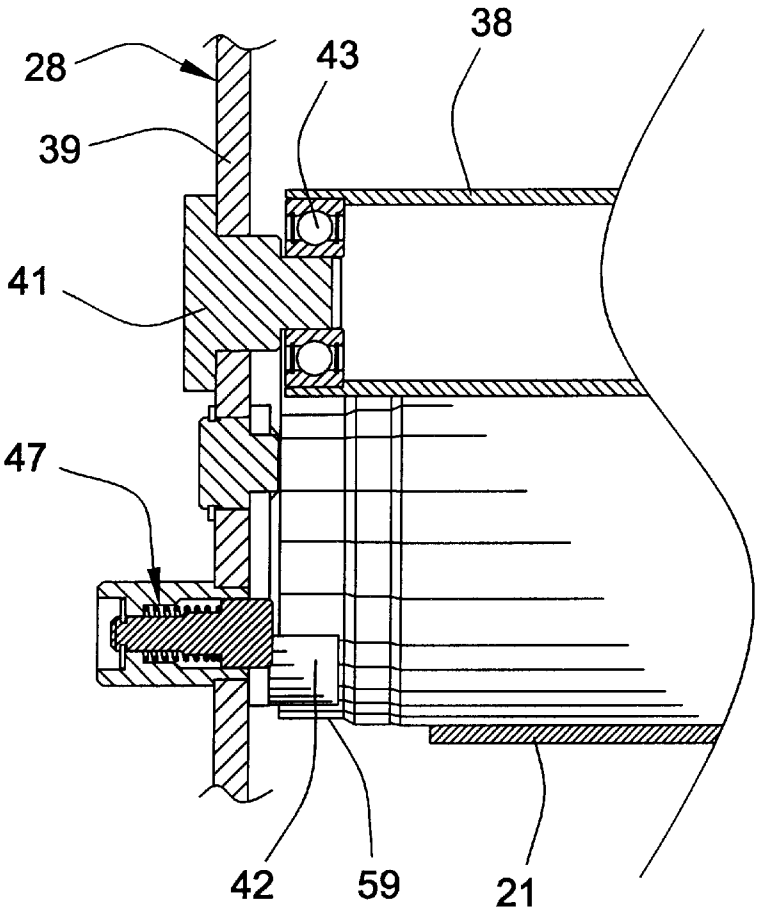

Greater detail of a preferred embodiment of the applicator roll 30, the supports in the form of a bearing roller 36 and transfer roll 38, the support arm 42 and locking mechanism 47 are illustrated in the partial fragmentary cross section of FIG. 10. As illustrated in FIG. 10, the applicator roll 30 includes a metal cylindrical drum 51, a felt transfer liner 53, a pair of end caps 55 enclosing the ends of the drum 51 and a pair of collars 57 that secure the liner 53 to the drum 51. The collars 57 in combination with the end caps 55 define cylindrical recesses 59 which provide a riding surface for the bearing roller 36. The collars 57 also provide beveled surfaces 61 which act as mechanical stops for axial retention of the applicator roll 30.

Figure 3:
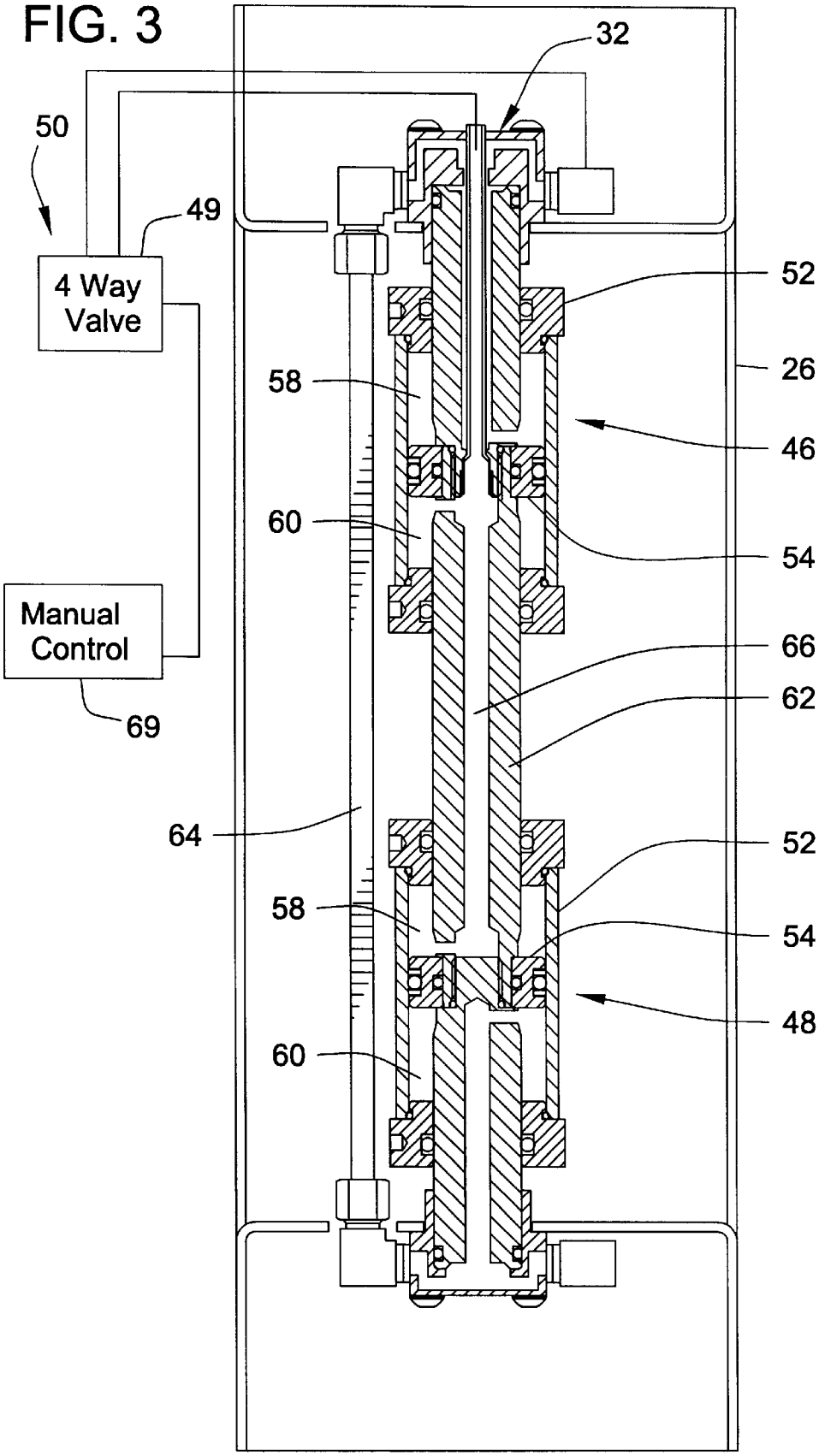
FIG. 3 is a cross-section of the roller coater apparatus of FIG. 1 taken about line 3—3 illustrating the plumbing of the pneumatic cylinder assembly (partially shown in schematic).
Figure 8:
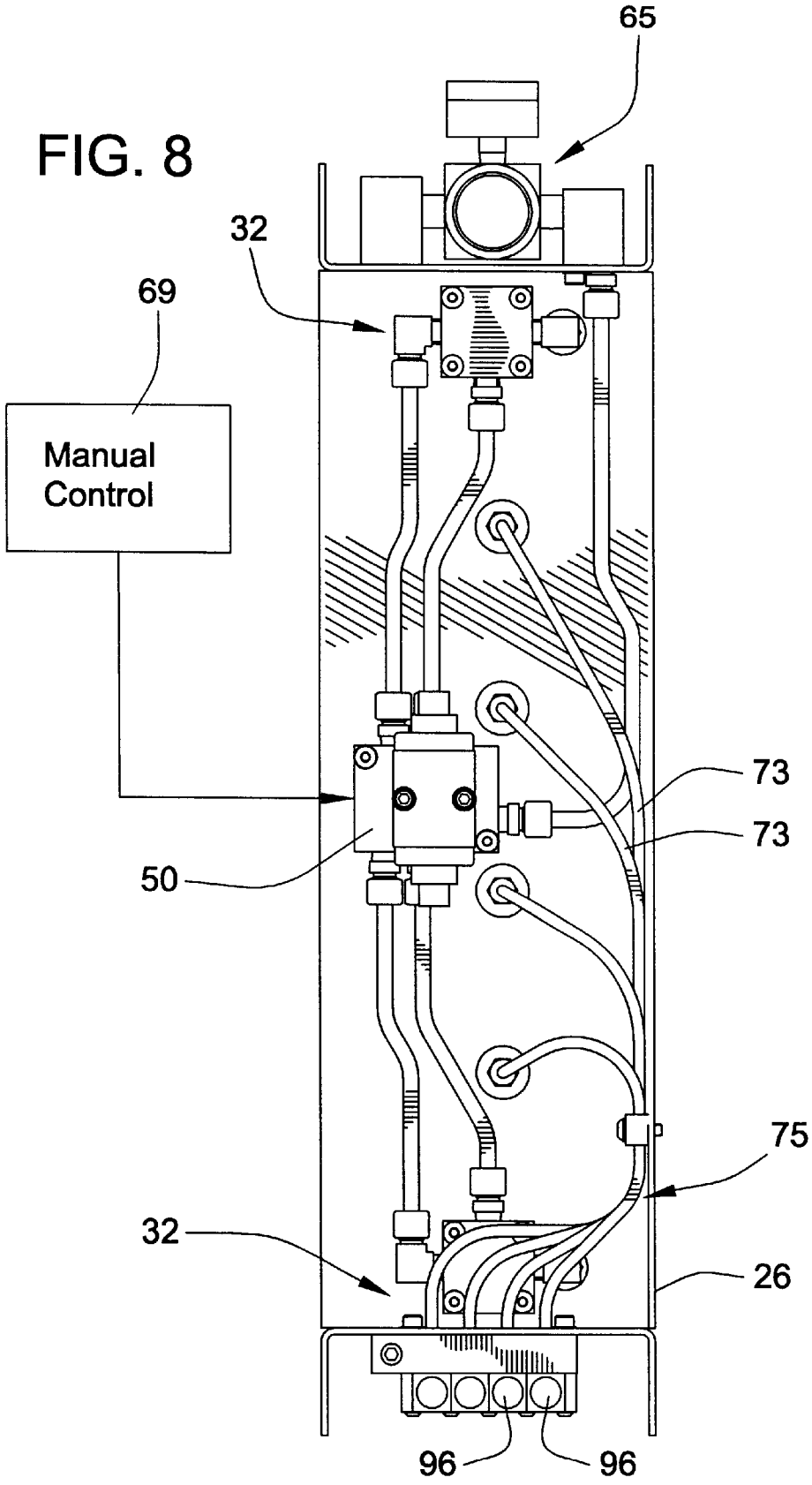
FIG. 8 is a top plan view of the roller coater apparatus illustrated in FIG. 1.

It is another aspect of the present invention, that the pneumatic cylinder assemblies 32 are operatively configured to allow the top and bottom roller coater assemblies 22, 24 to "float" or move vertically upwards or downwards in unison with the feed or flow of the sheet metal strip material 21. For lighter metal strip material the cylinders may also be supported in central position by a vertically adjustable shelf or support bar (not shown). Referring to FIGS. 1, 3 and 8, the pneumatic cylinder assemblies 32 generally include top and bottom pneumatic cylinders 46, 48 and a pneumatic control 50 operatively connected to the cylinders 46, 48 for selectively pressurizing or exhausting the pneumatic cylinders 46, 48 to move the support carriages 28 between engaged and disengaged positions. In the preferred embodiment, the pneumatic control 50 comprises a manually operated four-way valve 49 (two three-way valves) pneumatically connected to a compressed air supply 65 (which receives compressed air from a compressor and conditions the air appropriately) and connected to a manual control 69 for control thereby. Each of the pneumatic cylinders 46, 48 includes a cylinder housing 52 and a piston actuator 54. The housing 52 defines a cylindrical control chamber in which the piston actuator 54 is slidably mounted to facilitate linear translation between the piston actuator 54 and the housing 52.

The piston actuators 54 divide each of their corresponding control chambers into top and bottom pressure compartments 58, 60. In the preferred embodiment, the piston actuators 54 are secured to the frame 26 by a central vertical support shaft 62 extending through both top and bottom cylinders 46, 48. The housings 52 are fastened or pinned to the support structures 39 of the carriages 28 such that the cylinder housings 52 are movable relative to the frame 26 while the piston actuators 54 are stationary relative to the frame 26. However, it will be appreciated to one skilled in the art that the reverse could be true with the pistons secured to the carriages and the cylinder housings secured to the frame.

In the engaged position, the bottom compartments 60 of the top cylinders 46 and the top compartments 58 of the bottom cylinders 48 are pressurized to cause the roller coater assemblies 22, 24 to be biased towards one another and thereby pinch the sheet metal strip material 21 therebetween. While in the engaged position, the pneumatic actuator assemblies 32 are configured to allow the top and bottom roller coater assemblies 22, 24 to float in unison vertically upward and downward. To achieve this floatation, the top compartment 58 of each top cylinder 46 is connected by a first conduit 64 to the bottom compartment 60 of the corresponding bottom cylinder 48, and the bottom pressure compartment 60 of each top cylinder 46 is connected by a second conduit 66 to the top compartment 58 of the corresponding bottom cylinder 48 (See FIG. 3). As indicated in the preferred embodiment, the conduits 64, 66 are preferably provided entirely or partially by internal passages in the support shaft 62, or alternatively external hoses or pipes. It is an advantage that the internal passage of conduit 64 reduces the need for hoses on the apparatus 20.

Turning now to other details of the preferred embodiment, and particularly the lubricant applicator assembly 34, reference can be had to FIGS. 5–8. As illustrated, the lubricant applicator assembly 34 for each of the roller coater assemblies 22, 24 of the preferred embodiment generally includes at least one and preferably multiple dispensing heads 68 and the transfer roll 38 which as already indicated may also act as a support for the applicator roll 30. In operation, the feed of the sheet metal strip 31 drives the applicator roll 30 which in turn rotates the transfer roll 38 and thereby causes the transfer of lubricant from the heads 68 to the applicator roll 30.

The dispensing heads 68 include an elongate concave recessed surface 70 that is preferably cylindrical such that is closely receives the cylindrical outer periphery of the transfer roll 38. Each of the dispensing heads 68 includes an inlet port 72 for receiving lubricant from the hose 73 of a supply manifold 75, and an elongate outlet 74 that extends across the axial length of the transfer roll 38 for application of lubricant to the transfer roll 38. In the preferred embodiment, the outlet 74 takes the form of a continuous channel 76 formed in the head 68. However, it will be appreciated that multiple spaced apart holes arranged closely together along an axial length may also be used to provide the outlet 74. The outlet 74 is preferably configured to apply a uniform line of lubricant over the transfer roll 38.

Figure 5:
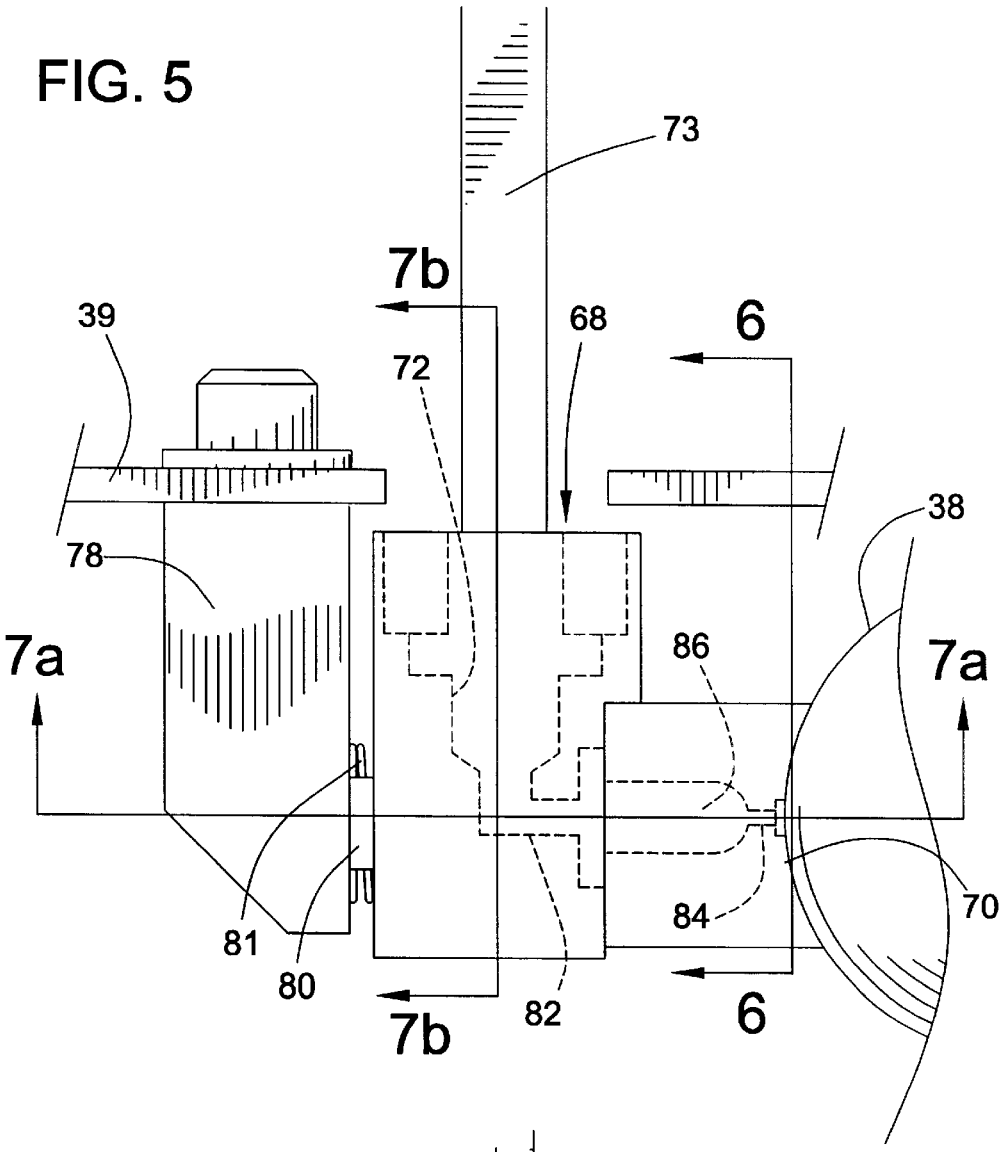
FIG. 5 is a side view of an applicator head used in the roller coater 10 apparatus of FIG. 1.
Figure 6:
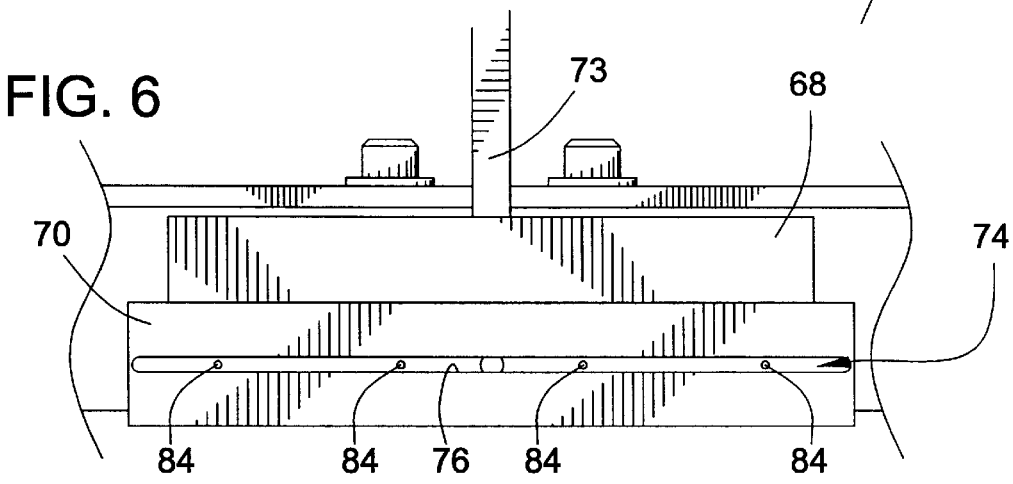
FIG. 6 is a front view of the applicator head shown in FIG. 5.
Figure 7A:
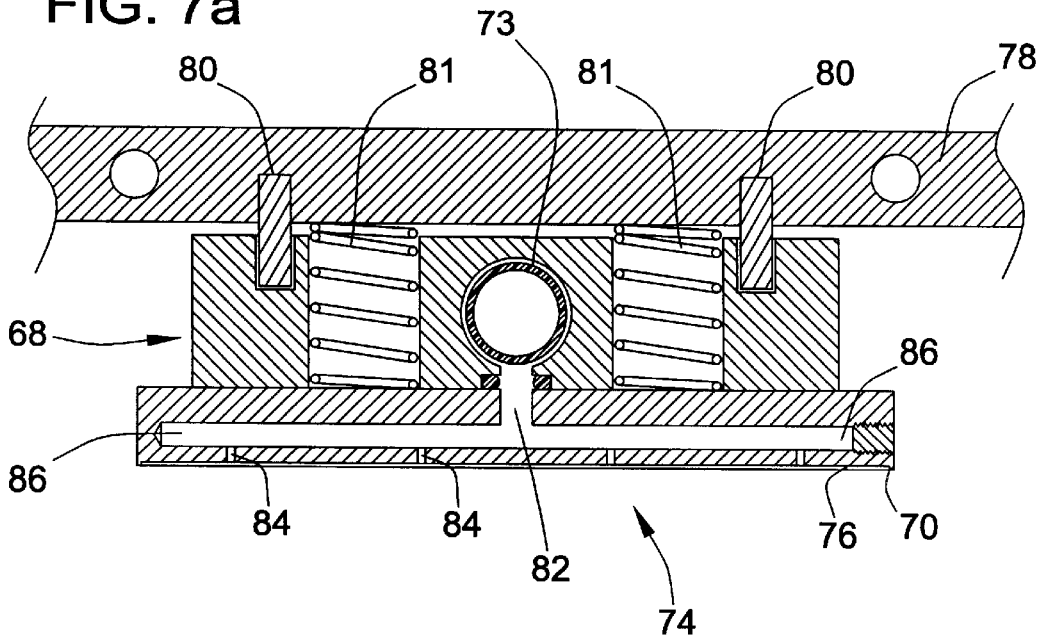
FIGS. 7*a* and 7*b* are cross sections of the applicator head shown in FIG. 5 taken about lines 7*a*—7*a* and 7*b*—7*b*, respectively.
Figure 7B:
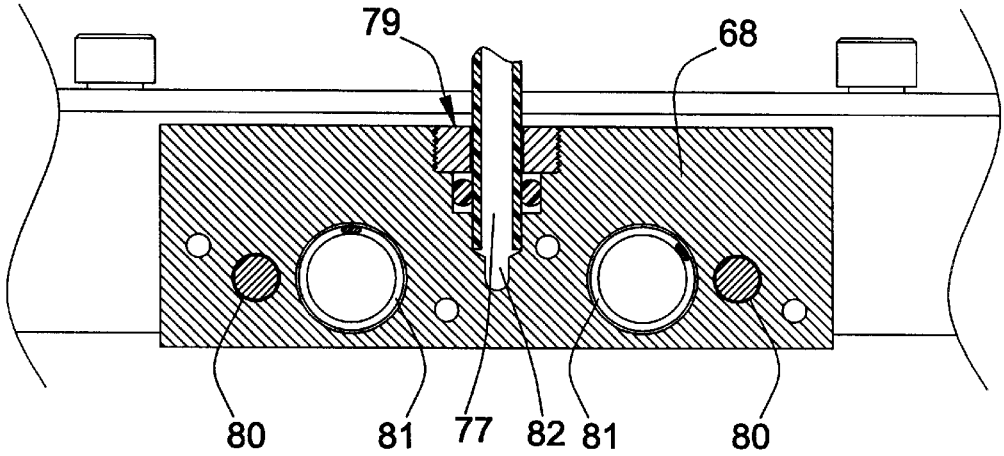

As indicated in FIGS. 5 and 7*a*, pins 80 are used to mount each dispensing head 68 on a support bracket in the form of an elongate support bar 78. The pins 80 slidably engage the head 68 to permit linear translation between each head 68 and the transfer roll 30. At least one spring 81 or other similar resilient mechanism is located between the support bar 78 and the head 68 to serve as means for urging the head 68 against the transfer roll 38 with the recess 70 seated against the outer surface thereof. In the preferred embodiment the head includes a sealed flow passageway 82 from the hose 73 to the outlet channel 76. The head 68 includes an inlet port 72 connected to the hose 73 by a suitable fitting 79 for reception of lubricant. To ensure relatively even lubricant distribution and pressure in the channel 76, multiple ports 84 are provided to connect the outlet channel 76 to an elongate lubricant collection chamber 86 inside the head 68.

Figure 4:
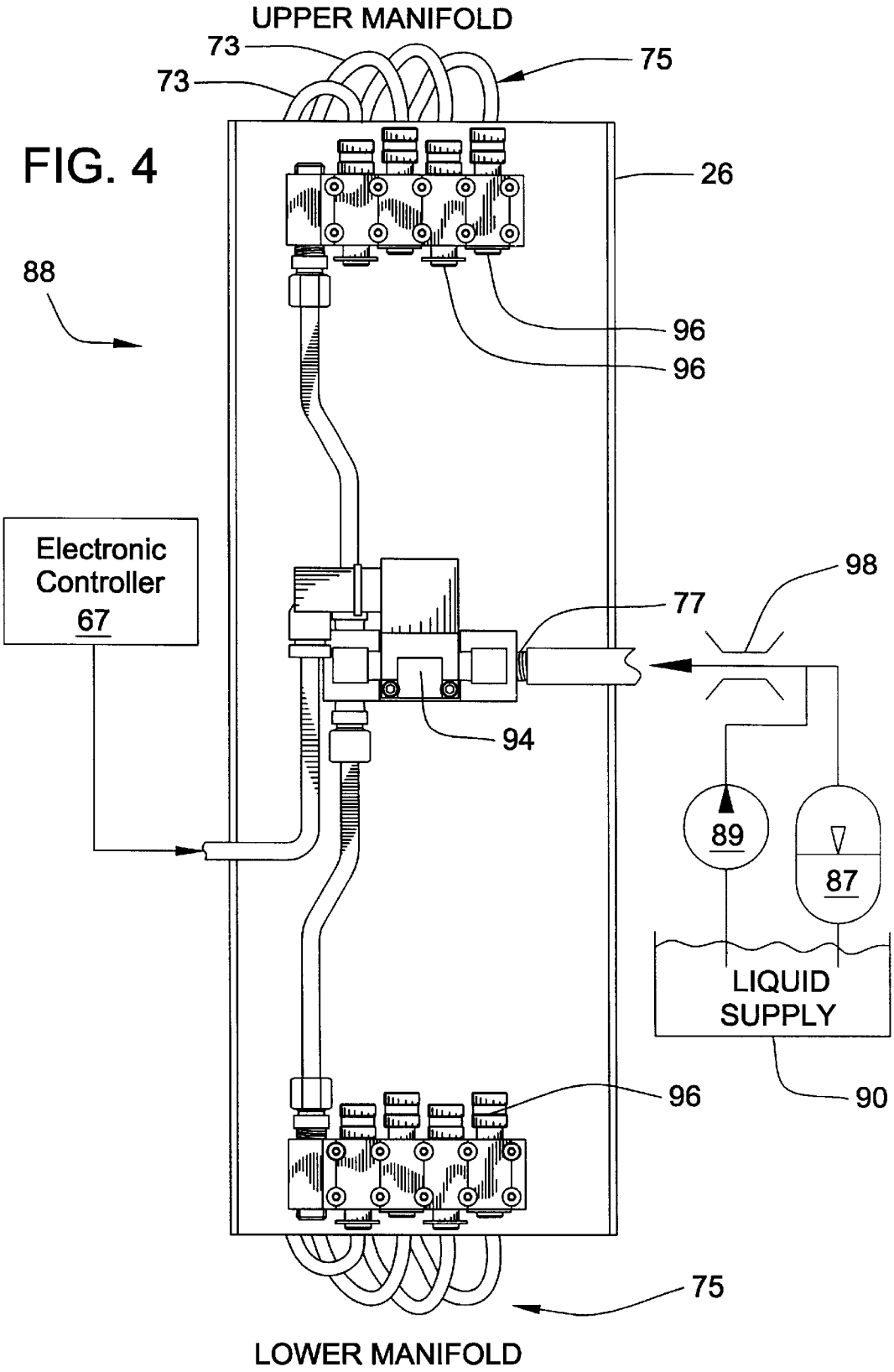
FIG. 4 is a side elevation view of the roller coater apparatus of FIG. 1, shown in partial schematic form, illustrating the lubricant supply assembly in greater detail.

Referring to FIGS. 1, 4 and 8, the roller coater apparatus 20 also includes a lubricant supply assembly 88 to feed and supply the dispensing heads 68 with lubricant. The lubricant supply assembly 88 is fed externally from either an air pressurized pressure pot 87 or fixed displacement (or variable displacement) pump 89, such as a piston pump, or both. The pump 89 or pressure pot 87 generally drive lubricant from a supply reservoir 90 into the inlet 77 of the lubricant supply assembly 88. The lubricant supply assembly 88 generally includes a control valve in the form of an electrically actuated solenoid valve 94, multiple on/off control valves 94, one for each dispensing head 68, and upper and lower supply manifolds 75 that include a hose 73 for each dispensing head 68. The on/off control valves 96 are manually operable and turn on or shut off flow to each of the dispensing heads 68. The control valves 96 are located in upper and lower sets in convenient locations for the upper and lower manifolds 75.

It is an aspect of the present invention, that an electronic controller modulates the electrically actuated solenoid valve 94 between different flow regulating positions at a selected frequency to set an application rate for lubricant application. It has been found that the modulating action along with the novel lubricant applicator assembly 34 provide a more uniform resulting application to the sheet metal strip 21. The modulating frequency depends upon the desired application rate to the sheet metal strip. In the preferred embodiment, fully open and closed position correspond to the two regulating positions of the solenoid valve 94, although partially open and closed positions may also be used. The electronic controller 67 can recall different application rates and can also compensate for the number of on/off valves that are open and closed. An optional restriction orifice 98 may also be provided upstream of the inlet port 77 for controlling the maximum amount of lubricant flow to the solenoid valve 94.

What is claimed is:

1. An apparatus for coating metal strip with laminate, the metal strip adapted to be fed through the apparatus, comprising:

a support frame;

top and bottom roller coaters carried on the support frame, adapted to pinch the metal strip therebetween in an engaged position, each of the roller coaters including:

an applicator roll contacting the metal strip at a first contact point while in the engaged position, the applicator roll adapted to receive and apply laminate, the applicator roll adapted to driven about a predetermined axis of rotation by the metal strip while in the engaged position; and a pair of support rolls engaging the applicator roll in the engaged position at second and third contact points, the first, second and third contact points being located at different angular positions about the predetermined axis to carry the applicator roll therebetween.

2. An apparatus for coating metal strip with laminate, the metal strip adapted to be fed through the apparatus, comprising:

a support frame;

top and bottom roller coaters carried on the support frame, adapted to pinch the metal strip therebetween in an engaged position, each of the roller coaters including:

an applicator roll contacting the metal strip at a first contact point while in the engaged position, the applicator roll adapted to receive and apply laminate, the applicator roll adapted to driven about a predetermined axis of rotation by the metal strip while in the engaged position; and a pair of supports engaging the applicator roll in the engaged position at second and third contact points, the first, second and third contact points being located at different angular positions about the predetermined axis to carry the applicator roll therebetween, wherein the applicator roll is not physically connected to any part of the apparatus.

3. The apparatus of claim 2 wherein the roller coaters are movable apart from each other from the engaged position to a disengaged positions wherein the metal strip is not pinched to facilitate loading of metal strip, the upper roller coater further comprising:

support means for supporting the bottom of the applicator roll and retaining the applicator roll in the upper roller coater.

4. The apparatus of claim 3 wherein the support means is two sets of support arms, each set being spaced apart along the predetermined axis, the arms of each set defining fourth and fifth contact points spaced at an angular spacing about to the predetermined axis for holding the bottom of the roller coater, one arm of each set being movable from the other arm to allow for removal of the applicator roller.

5. The apparatus of claim 2 wherein one of the supports is a transfer roll, the apparatus including a manifold for supplying laminate to the applicator roll, wherein each roller coater further includes:

at least one applicator head having an inlet connected to the manifold for receiving laminate, a longitudinal outlet, and a recessed surface closely receiving the outer peripheral surface of the transfer roll, the inlet communicating laminate to the outlet for application of laminate to the transfer roll, the longitudinal outlet being defined in the recessed surface and extending substantially across the axial length of the transfer roll for applying laminate to the transfer roll, wherein the transfer roll contacts the applicator roll along a laminate transfer line parallel with the predetermined axis for application of laminate to the applicator roll.

6. The apparatus of claim 5, further comprising:

a control valve having a pressurized input of laminate and at least two different positions corresponding to different output flows;

a manifold connecting the output flow of the control valve to the at least one head; and means for modulating the valve between the at least two different positions to set an application rate of the controlled amount of laminate, the modulating means being controllable to change the application rate.

7. The apparatus of claim 2 wherein the laminate is a lubrication suitable for lubrication of a press machine, the apparatus being situated upstream of the press machine lubricating the metal strip prior to reaching the press machine.

8. An apparatus for coating metal strip with laminate, the metal strip adapted to be fed through the apparatus, comprising:

a support frame;

top and bottom roller coaters carried on the support frame, adapted to pinch the metal strip therebetween in an engaged position, each of the roller coaters including:

an applicator roll contacting the metal strip at a first contact point while in the engaged position, the applicator roll adapted to receive and apply laminate, the applicator roll adapted to driven about a predetermined axis of rotation by the metal strip while in the engaged position;

a pair of supports engaging the applicator roll in the engaged position at second and third contact points, the first, second and third contact points being located at different angular positions about the predetermined axis to carry the applicator roll therebetween; and top and bottom support carriages for the top and bottom roller coaters, the support rolls being secured to the carriages, the applicator rolls not being physically connected to the respective top and bottom support carriages.

9. The apparatus of claim 8, further comprising:

at least one top and at least one bottom pneumatic cylinders supported by the support frame and connected to the top and bottom carriages, respectively, each pneumatic cylinder including a housing defining a control chamber and a piston actuator slidably disposed in the control chamber dividing the control chamber into upper and lower pressure compartments;

a first conduit fluidically connecting the upper and lower compartments of the top and bottom cylinders, respectively;

a second conduit fluidically connecting the lower and upper compartments of the top and bottom cylinders, respectively; and a pneumatic control having a pressurized input, the pneumatic control being operatively connected to the to top and bottom cylinders being operable to selectively move the roller coaters towards or away from each other, the top and bottom carriages being movable both upwards and downwards in unison via pneumatic flow through the first and second conduits when the pneumatic control is not operating the cylinders.

10. An apparatus for coating metal strip with laminate, the metal strip adapted to be fed through the apparatus, comprising:

a support frame;

top and bottom roller coaters carried on the support frame, adapted to pinch the metal strip therebetween in an engaged position, each of the roller coaters including:

an applicator roll contacting the metal strip at a first contact point while in the engaged position, the applicator roll adapted to receive and apply laminate, the applicator roll adapted to driven about a predetermined axis of rotation by the metal strip while in the engaged position; and a pair of supports engaging the applicator roll in the engaged position at second and third contact points, the first, second and third contact points being located at different angular positions about the predetermined axis to carry the applicator roll therebetween, wherein the supports comprise support rolls having respective axes of rotation parallel to the predetermined axis.

11. An apparatus for coating metal strip with laminate, the metal strip adapted to be fed through the apparatus, comprising:

a support frame;

top and bottom roller coaters carried on the support frame, adapted to pinch the metal strip therebetween in an engaged position, each of the roller coaters including:

an applicator roll contacting the metal strip at a first contact point while in the engaged position, the applicator roll adapted to receive and apply laminate, the applicator roll adapted to driven about a predetermined axis of rotation by the metal strip while in the engaged position; and a pair of supports engaging the applicator roll in the engaged position at second and third contact points, the first, second and third contact points being located at different angular positions about the predetermined axis to carry the applicator roll therebetween, wherein at least one of the supports comprise a pair of roller assemblies, each roller assembly comprising a stationary support shaft and a roller mounted on the support shaft for rotation relative thereto, the rollers engaging reduced diameter recesses in the ends of the applicator roll.

12. An apparatus for coating metal strip with laminate, the apparatus comprising:

a support carriage;

an applicator roll carried by the support carriage for rotation about a first axis, the applicator roll being adapted to receive and apply laminate to metal strip;

a transfer roll carried by the support carriage for rotation about a second axis, the transfer roll contacting the applicator roll along a laminate transfer line generally parallel with the first and second axes for transferring laminate from the transfer roll to the applicator roll;

at least one dispensing head having an inlet for receiving laminate, a longitudinal outlet, and a recessed surface closely receiving the outer peripheral surface of the transfer roll, the inlet being in fluid communication with the outlet, the longitudinal outlet being defined in the recessed surface and extending substantially across the axial length of the transfer roll for applying laminate to the transfer roll;

a control valve having a pressurized input of laminate and at least two different positions corresponding to different output flows;

a manifold connecting the output flow of the control valve to the at least one head;

means for modulating the valve between the at least two different positions to set an application rate of the controlled amount of laminate, the modulating means being controllable to change the application rate;

wherein the control valve is an electrically actuated solenoid valve having open and closed positions, and the modulating means is an electronic controller in electrical communication with the solenoid valve; and wherein the apparatus has an engaged position in which the applicator roll contacts the metal strip at a first contact point, the applicator roll adapted to driven about a predetermined axis of rotation by the metal strip while in the engaged position, the transfer roll supporting the applicator roll at a second contact point, and further comprising means for supporting the applicator roll at a third contact point, the first, second and third contact points being located at different angular positions about the first axis to carry the applicator roll therebetween without journalling the applicator roll in bearings.

13. The apparatus of claim 12 further comprising spring means for urging the at least one dispensing head against the transfer roll.

14. The apparatus of claim 12 wherein the longitudinal outlet is a continuous elongate channel extending parallel with the first and second axes.

15. The apparatus of claim 12 wherein the transfer roll is driven by the applicator roll to rotate in the opposite direction of the applicator roll.

16. The apparatus of claim 12 wherein the applicator roll is movable from the engaged position in a direction away from the metal strip to a disengaged position wherein the metal strip is not supporting the applicator roll, the apparatus further comprising:

means for replacing the first contact point and supporting the bottom of the applicator roll in the disengaged position.

17. The apparatus of claim 16 wherein the laminate is a lubrication suitable for lubrication of a press machine, the apparatus being situated upstream of the press machine lubricating the metal strip prior to reaching the press machine.

18. An apparatus for coating metal strip with laminate, the metal strip adapted to be feed through the apparatus, comprising:

a support frame;

top and bottom carriages carried by the support frame and movable relative to the support frame towards and away from each other, the top and bottom carriages supporting top and bottom roller coaters, respectively, the carriages being movable towards each other to pinch the metal strip therebetween for application of laminate and away from each other to facilitate loading of metal strip;

at least one top and at least one bottom pneumatic cylinders supported by the support frame and connected to the top and bottom carriages, respectively, each pneumatic cylinder including a housing defining a control chamber and a piston actuator slidably disposed in the control chamber and dividing the control chamber into upper and lower pressure compartments;

a first conduit fluidically connecting the upper and lower compartments of the top and bottom cylinders, respectively;

a second conduit fluidically connecting the lower and upper compartments of the top and bottom cylinders, respectively; and a pneumatic control having a pressurized input, the pneumatic control being operatively connected to the to top and bottom cylinders being operable to selectively move the roller coaters towards or away from each other, the top and bottom carriages being movable both upwards and downwards in unison via pneumatic flow through the first and second conduits when the pneumatic control is not actuating the cylinders.

19. The apparatus of claim 18 wherein the housings of the top and bottom pneumatic cylinders are affixed to the top and bottom carriages, respectively, and wherein the piston actuators are affixed to the support frame, whereby the piston actuators are stationary and the housings are movable.

20. The apparatus of claim 18 wherein, each of the roller coaters includes:

an applicator roll contacting the metal strip at a first contact point while in the engaged position, the applicator roll adapted to receive and apply laminate, the applicator roll adapted to driven about a predetermined axis of rotation by the metal strip while in the engaged position; and a pair of supports engaging the applicator roll in the engaged position at second and third contact points, the first, second and third contact points being located at different angular positions about the predetermined axis to carry the applicator roll therebetween.

21. The apparatus of claim 20 wherein the roller coaters are movable apart from each other from the engaged position to a disengaged positions wherein the metal strip is not pinched to facilitate loading of metal strip, the upper roller coater further comprising:

support means for supporting the bottom of the applicator roll and retaining the applicator roll in the upper roller coater.

22. The apparatus of claim 21 wherein the support means is two sets of support arms, each set being spaced apart along the predetermined axis, the arms of each set defining fourth and fifth contact points spaced at an angular spacing about to the predetermined axis for holding the bottom of the roller coater, one arm of each set being movable from the other arm to allow for removal of the applicator roller.

23. The apparatus of claim 22 wherein each roller coater further comprises retaining spring loaded stops engaging the axial ends of the applicator roll for axial retention of the applicator roll.

24. The apparatus of claim 22 wherein the apparatus includes a manifold for supplying laminate to the applicator roll, wherein each roller coater further includes:

at least one applicator head having an inlet connected to the manifold for receiving laminate, a longitudinal outlet, and a recessed surface closely receiving the outer peripheral surface of one of the support rolls, the inlet communicating laminate to the outlet for application of laminate to the support roll, the longitudinal outlet being defined in the recessed surface and extending substantially across the axial length of the support roll for applying laminate to the support roll, wherein the support roll contacts the applicator roll along a laminate transfer line parallel with the predetermined axis for application of laminate to the applicator roll.

25. The apparatus of claim 24 further comprising:

a control valve having a pressurized input of laminate and at least two different positions corresponding to different output flows;

a manifold connecting the output flow of the control valve to the at least one head; and means for modulating the valve between the at least two different positions to set an application rate of the controlled amount of laminate, the modulating means being controllable to change the application rate.

26. An apparatus for coating metal strip with laminate, the metal strip adapted to be fed through the apparatus, comprising:

at least one roller coater having an applicator roll for rotation about a first axis and a plurality of dispensing heads, the applicator roll being adapted to receive and apply laminate to metal strip, the dispensing heads supplying a controlled amount of laminate to the applicator roll;

a control valve having a pressurized input of laminate and at least two different positions corresponding to different output flows;

a manifold connecting the output flow of the control valve to each of the dispensing heads;

means for modulating the valve between the at least two different flow regulating positions to set an application rate of the controlled amount of laminate, the modulating means being controllable to change the application rate; and wherein the roller coater further includes at least one transfer roll disposed between the dispensing heads and the applicator roll, the transfer roll carried by the support carriage for rotation about a second axis, the transfer roll contacting the applicator roll along a laminate transfer line generally parallel with the first and second axes for transferring laminate from the transfer roll to the applicator roll, the dispensing heads each having an inlet connected to the manifold, a longitudinal outlet, and a recessed surface closely receiving the outer peripheral surface of the transfer roll, the inlet being in fluid communication with the outlet, the longitudinal outlet being defined in the recessed surface and extending substantially across the axial length of the transfer roll for applying laminate to the transfer roll.

* * * * *